United States Patent [19]

Vogel

[11] Patent Number: 4,517,692

[45] Date of Patent: May 21, 1985

[54] ANTI-DECUBITUS WATERFLOATATION SYSTEM

[75] Inventor: Peter Vogel, Lausanne, Switzerland

[73] Assignee: Ardo International Marketing, Switzerland

[21] Appl. No.: 471,587

[22] Filed: Mar. 3, 1983

[51] Int. Cl.[3] ..... A47C 27/08

[52] U.S. Cl. ..... 5/451; 5/481

[58] Field of Search ..... 5/451, 452, 450, 449, 5/422, 400, 481

[56] References Cited

U.S. PATENT DOCUMENTS

| | | | |
|---|---|---|---|
| 3,600,727 | 8/1971 | Williams | 5/455 |
| 3,689,949 | 9/1972 | Weinstein et al. | 5/451 |
| 3,735,432 | 5/1973 | Kreten et al. | 5/451 |
| 3,842,455 | 10/1974 | Whitney | 5/455 |
| 3,872,525 | 3/1975 | Lea et al. | 5/450 |
| 4,245,364 | 1/1981 | Calleance | 5/452 |
| 4,352,217 | 10/1982 | O'Rourke | 5/400 |

OTHER PUBLICATIONS

WO-81/01792 Published on Jul. 9, 1981, Vogel's PCT/CH80/00159 Application.

*Primary Examiner*—Alexander Grosz
*Attorney, Agent, or Firm*—Mortenson & Uebler

[57] ABSTRACT

Waterfloatation systems to prevent decubitus ulcers are known, but they suffer the disadvantages that systems having foam frames require a large volume for storage and transport. Modular systems which are very handy for hospitals normally are too expensive for home patients. This invention provides a floatation system having a foam frame which can be reduced to a very small volume and which can be used as a waterfloatation support for home patients at a considerably lower cost than conventional systems.

3 Claims, 7 Drawing Figures

ANTI-DECUBITUS WATERFLOATATION SYSTEM

BACKGROUND OF THE INVENTION

Waterfloatation systems for the prevention and healing of decubitus ulcers, for example on burn patients, are known. Known systems, however, usually have the following disadvantages:

Waterproof frames utilizing foam material make storage and transport difficult because of their large volumes; and Systems which consist of various elements and which use up to 3 individual water-chambers, in order to make use of the system in a hospital easier, have the disadvantage that their cost is too high, especially for home-patient use.

SUMMARY OF THE INVENTION

A waterproof frame and basin apparatus for anti-decubitus waterfloatation is provided comprising longitudinal side frame members fabricated of a plastic foam material which is heat sealed into plastic side compartments, the compartments having at least one air escape opening to permit the compression of the foam frame members for storage and shipping, thereby reducing the total volume of the frame to a fraction of its uncompressed volume, and having a plastic bottom and end members forming, together with the frame members, the watertight frame and basin apparatus.

Preferably the apparatus is used in combination with a water mattress made of a soft plastic material and having at least two independent compartments which are each equipped with a water valve, fitting snugly into the frame and basin, the two specific dimensions of the individual compartments of the mattress providing a choice as to water support for a bed-ridden patient, either head or body or both, corresponding to the degree of the decubitus-risk of the patient.

The frame and basin and the water mattress can be fabricated in one piece.

DETAILED DESCRIPTION OF THE INVENTION AND PREFERRED EMBODIMENTS WITH REFERENCE TO THE DRAWINGS

Waterfloatation systems to prevent decubitus ulcers are known, but they suffer the disadvantages that systems having foam frames require a large volume for storage and transport. Modular systems which are very handy for hospitals normally are too expensive for home patients.

This invention provides a floatation system having a foam frame which can be reduced to a very small volume and which can be used as a waterfloatation support for home patients at a considerably lower cost than conventional systems.

This invention is based on recognitions on which copending patent applications Ser. Nos. 408,289 and 421,846 were based and eliminates the disadvantages of kmown systems as mentioned above. The invention provides a waterproof basin with fully sealed-in foam frames on the sides. Pockets which enclose the foam parts are equipped with small openings which allow the air contained within the foam to escape when the frame is rolled or pressed into a small volume. In this way, the volume can be reduced to a fraction of its normal full volume for easy transportation and storage. A further advantage of this invention lies in the creation of a water mattress in a single piece, but being subdivided into two water compartments having individual water valves. The special dimensions of the two water compartments permit the choice of filling only the larger compartment with water, while the smaller compartment (head part) can be inflated with air or left empty, in which case it would be replaced by a normal pillow. In such a way a water support for patients is formed which reaches from heels to shoulders which is sufficient for a large number of decubitus-risk patients. This water support in this embodiment weighs only approximately 45 kg. For patients with especially high decubitus-risk, the head compartment of the water mattress can also be filled with water. In this embodiment, the entire patient body will rest on water support. This total waterfloatation support weighs approximately 55 kg. A third advantage of this invention concerns an anti-decubitus waterfloatation support system fabricated in one single piece. It combines two side frame members with a water mattress therebetween having two individual water compartments. The longitudinal frame members on the sides stabilize the water mattress and decrease the danger of a patient rolling off the water mattress. This combination system has been invented especially for home patients, where the floatation system is usually left stationary on the bed and where a low cost is especially important.

Figure 1:
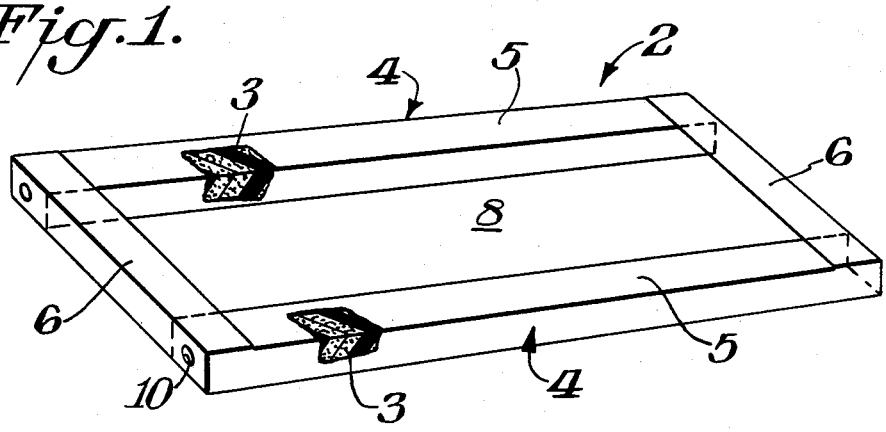
FIG. 1 is a top plan view of the waterfloatation system of this invention.

The detailed description of the invention is best provided with reference to the drawings, wherein FIG. 1 is a top plan view, in part broken away showing the waterfloatation frame and basin apparatus 2 having side frame members 4 comprised of compartments 3 and plastic foam inserts 4, shown broken away. The frame and basin apparatus has end flaps 6 and bottom 8. The frame and basin can be fabricated from conventional resilient plastic materials which are readily available.

Figure 2:
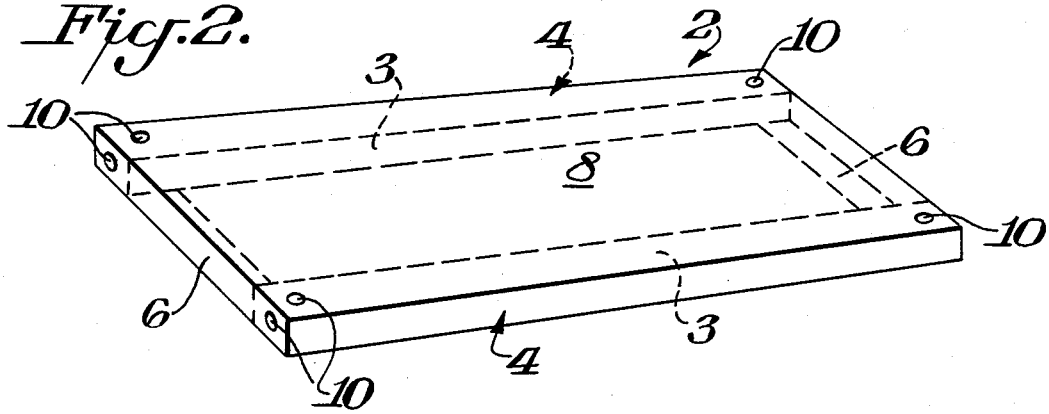
FIG. 2 is a bottom plan view of the system.

FIG. 2 shows a bottom plan view of the frame and basin apparatus having side frame members 4, end flaps 6 and bottom 8. Openings 10 located near the corners of the frame and basin apparatus are an important feature of this invention. It is these openings which allow air to escape from foam members 3 and compartments 5 which provides highly reduced volume for storage when the frame apparatus is rolled up or folded.

Figure 3:
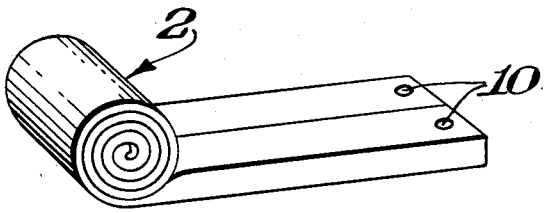
FIG. 3 is a schematic diagram of the system of this invention partially rolled up and compressed for storage.

FIG. 3 shows a schematic diagram of the frame apparatus partially rolled up for storage, the air being expelled through openings 10.

Figure 4:
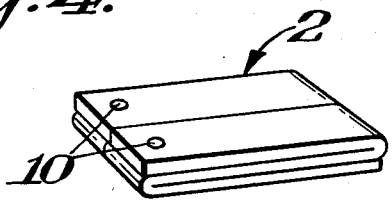
FIG. 4 is a schematic diagram of the waterfloatation system folded and compressed for storage.

FIG. 4 shows schematically the frame in a folded configuration for storage.

Figure 5:
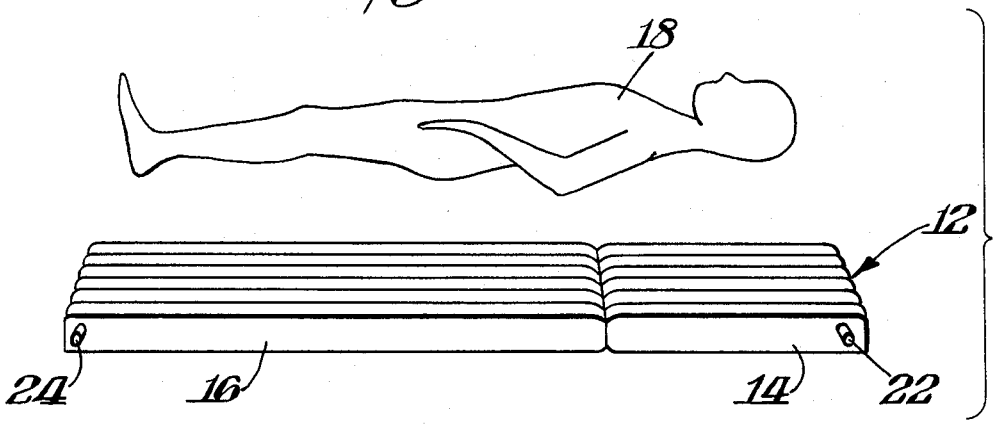
FIG. 5 shows a one-piece water mattress having two individual water compartments which permit adjustment of the length of the water support to the degree of decubitus risk to the patient.

FIG. 5 shows the preferred floatation mattress 12 to be used together with the frame of this invention. This mattress has two water compartments, one, 14, for the head and one, 16, for the body. Each has a separate water valve, 22 and 24, respectively. Patient 18 is shown for completeness.

Figure 6:
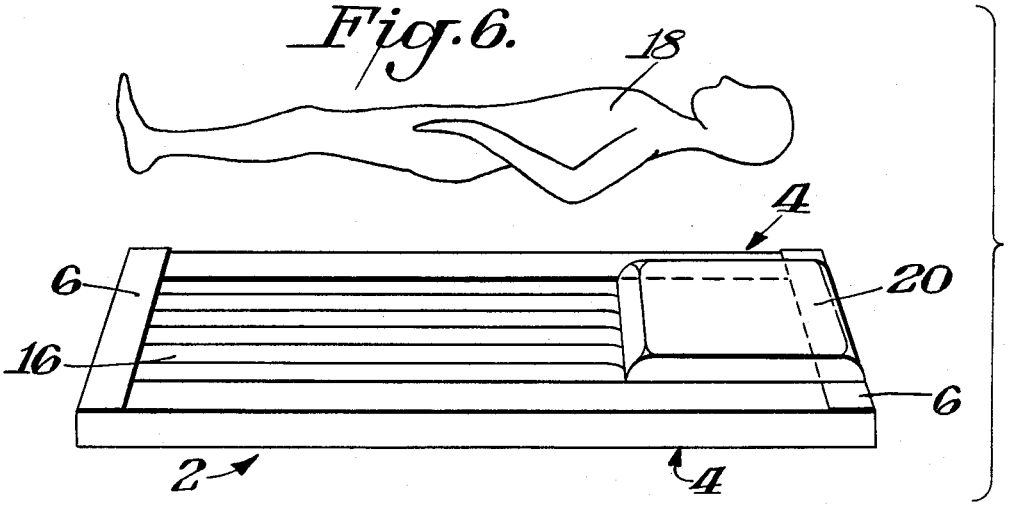
FIG. 6 shows a one-piece combination floatation system with side frame members on both sides and with the larger water compartment filled with water, the smaller compartment (head) being empty and a conventional pillow being substituted.

FIG. 6 shows the preferred mattress used together with the frame and basin apparatus of this invention. Frame members 4 hold the mattress in place with body compartment 16 filled with water and head compartment 14 empty, with a conventional pillow 20 being used for head support.

Figure 7:
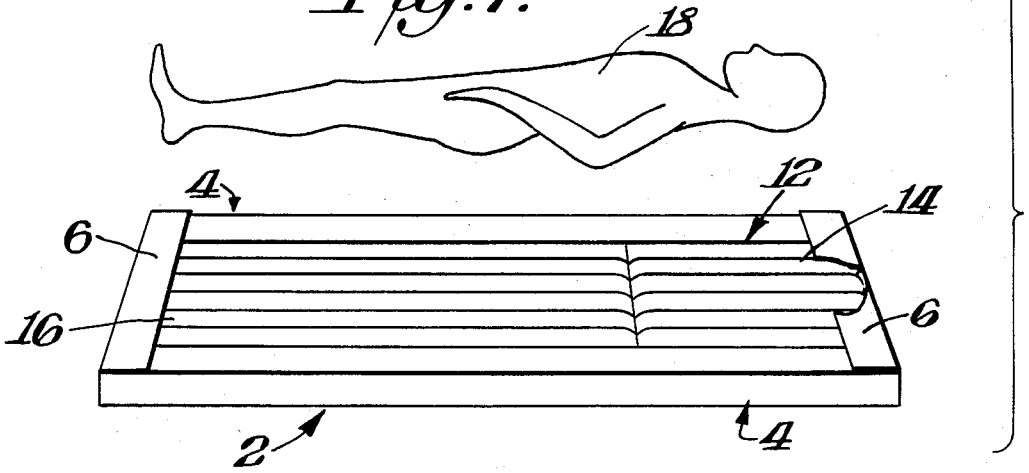
FIG. 7 shows the one-piece combination waterfloatation system of this invention with side frame members on both sides and both water compartments filled with water.

FIG. 7 shows the frame apparatus holding the water mattress having both body compartments 16 and head compartment 12 being filled with water and held in place by frame members 4.

While the invention has been disclosed herein in connection with certain embodiments and detailed descriptions, it will be clear to one skilled in the art that modifications or variations of such details can be made without deviating from the gist of this invention, and such modifications or variations are considered to be within the scope of the claims hereinbelow.

What is claimed is:

1. A one piece, integral waterproof frame and basin apparatus for anti-decubitus waterfloatation comprising longitudinal side frame members fabricated of a highly compressible plastic foam material which is heat sealed into plastic side compartments each said compartment having at least one air escape opening to permit the compression of the foam frame members for storage and shipping, thereby reducing the total volume of the frame to a fraction of its uncompressed volume, and having a plastic bottom and end members forming, together with said frame members, said watertight frame and basin apparatus.

2. The apparatus of claim 1 in combination with a water mattress made of a soft plastic material and having at least two independent compartments which are each equipped with a water valve, fitting snugly into said frame and basin, the two specific dimensions of the individual compartments of said mattress providing a choice as to water support for a bed-ridden patient, either head or body or both, corresponding to the degree of the decubitus-risk of said patient.

3. The combination anti-decubitus apparatus of claim 2 in which said frame and basin and said water mattress are fabricated in one piece.

* * * * *